US006368101B1

(12) United States Patent
Briggs et al.

(10) Patent No.: US 6,368,101 B1
(45) Date of Patent: Apr. 9, 2002

(54) FLAME RETENTION HEAD AND NOZZLE BLOCK ASSEMBLY FOR WASTE OIL-BURNING SYSTEMS

(75) Inventors: Eugene C. Briggs, Dayton, OH (US); Wayne Robertson, Nashville, TN (US); Christopher L. Gansel, Hill City, KS (US)

(73) Assignee: Black Gold Corporation, Nashville, TN (US)

( * ) Notice: Subject to any disclaimer, the term of this patent is extended or adjusted under 35 U.S.C. 154(b) by 0 days.

(21) Appl. No.: 09/575,279

(22) Filed: May 22, 2000

(51) Int. Cl.[7] ..... F23M 9/00

(52) U.S. Cl. ..... 431/182; 431/183; 431/187; 431/265; 239/406

(58) Field of Search ..... 431/8, 9, 182, 431/183, 184, 187, 265, 350, 351, 353, 264; 239/402, 406

(56) References Cited

U.S. PATENT DOCUMENTS 3,694,135 A * 9/1972 Dancy et al. ..... 431/183
4,082,495 A * 4/1978 Lefebvre ..... 431/183
4,561,841 A * 12/1985 Korenyi ..... 431/265
5,460,514 A * 10/1995 Toypshima et al. ..... 431/182
6,048,197 A * 4/2000 Beiler ..... 431/183

* cited by examiner

*Primary Examiner*—James C. Yeung
(74) *Attorney, Agent, or Firm*—Michael E. McKee

(57) ABSTRACT

A flame retention head for a nozzle block assembly of a waste oil-burning system, such as a furnace, having a combustion zone within which oil is burned in the presence of air utilizes a platen-like body of substantially circular form having a central opening through which an atomizing nozzle is positioned for directing air and oil into the combustion zone for burning. The central opening has a diameter of no less than about 1.3 inches, and the platen-like body including a plurality of radially-extending vanes formed therein wherein each vane forms with the remainder of the platen-like body a gap which is joined to and extends radially-outwardly of the central opening. Each gap formed by a vane has a width which is no less than about 0.07 inches. Associated with the nozzle block assembly is at least one air vane for balancing the air flow moving past the flame retention head and toward the combustion zone. When oil and air are directed into the combustion zone for burning, the retention head ensures that the resulting burn is complete so that relatively few hydrocarbons, if at all, are left unburned.

21 Claims, 2 Drawing Sheets

FLAME RETENTION HEAD AND NOZZLE BLOCK ASSEMBLY FOR WASTE OIL-BURNING SYSTEMS

BACKGROUND OF THE INVENTION

This invention relates generally to systems which utilize waste oil as fuel and relates, more particularly, to the means with which fuel and air are delivered to the combustion zone of such a system for burning.

It is known that unburned hydrocarbons and carbon monoxide emissions from fuel-burning equipment can present a threat to health and safety. For example, the Environmental Protection Agency has determined that unburned hydrocarbons and carbon monoxide can contribute to higher levels of smog and air pollution and can contribute to global warming. Furthermore, the breathing of unburned hydrocarbons can increase the risk of cancer and can lead to other health problems.

Unburned hydrocarbons and attending carbon monoxide are the result of incomplete combustion. Therefore, it is desirable that all of the hydrocarbons and combustible impurities used in waste oil and fuel oil-burning equipment be burned within the equipment. It is a greater challenge in waste oil-burning equipment (than in fuel oil-burning furnaces) to effect complete combustion because waste oil is harder to burn and has much higher levels of cancer-causing hydrocarbons, referred to as PAHs (short for polynuclear aromatic hydrocarbons), than does fuel oil. Moreover, unburned hydrocarbons represent a waste of energy and increase the potential for soot fires in an exhaust flue. It would therefore be desirable to provide an oil-burning system, such as a furnace, with the capacity to completely burn the fuels delivered to the combustion zone of such a system.

Accordingly, it is an object of the present invention to provide a new and improved combustion burner assembly for a waste oil-burning system whose components contribute to the completeness of the burning of the fuels delivered to the combustion zone of such a furnace.

Another object of the present invention is to provide such a burner assembly whose operation increases the efficiency of the burn of fuel delivered to the combustion zone of an oil-burning system and consequently reduces the amount of unburned hydrocarbons which are permitted to escape into the surrounding environment.

Still another object of the present invention is to provide such a burner assembly whose components are uncomplicated in construction yet effective in operation.

Yet another object of the present invention is to provide a new and improved flame retention head for use in a burner assembly of an oil-burning system.

A further object of the present invention is to provide such a flame retention head which contributes to the completeness of the burning of the oil being burned in the oil-burning system.

A still further object of the present invention is to provide such a flame retention head which is uncomplicated in construction yet effective in operation.

SUMMARY OF THE INVENTION

This invention resides in a flame retention head for a nozzle block assembly of a waste oil-burning system having a combustion zone within which oil is burned in the presence of air and wherein the nozzle block assembly includes an atomizing nozzle through which oil and air are delivered to the combustion zone of the system for burning.

The flame retention head includes a platen-like body of substantially circular form having a central opening through which the atomizing nozzle is positioned for directing air and oil into the combustion zone for burning, and wherein the central opening has a diameter of no less than about 1.3 inches. In addition, the platen-like body includes a plurality of radially-extending vanes formed therein wherein each vane forms with the remainder of the platen-like body a gap which is joined to and extends radially-outwardly of the central opening and wherein each gap has a width which is no less than about 0.07 inches.

BRIEF DESCRIPTION OF THE DRAWINGS

FIG. 4.

DETAILED DESCRIPTION OF THE ILLUSTRATED EMBODIMENT

Figure 1:
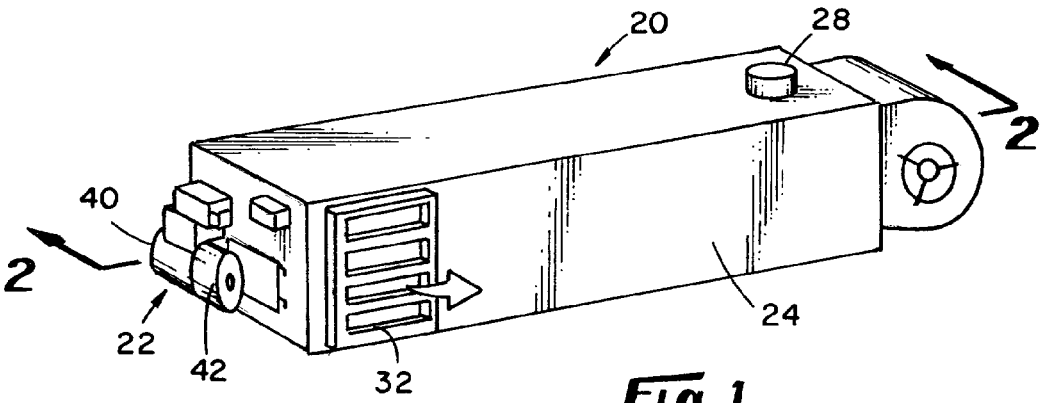
FIG. 1 is a perspective view of a furnace within which a burner assembly having components embodying features of the present invention is utilized.
Figure 2:
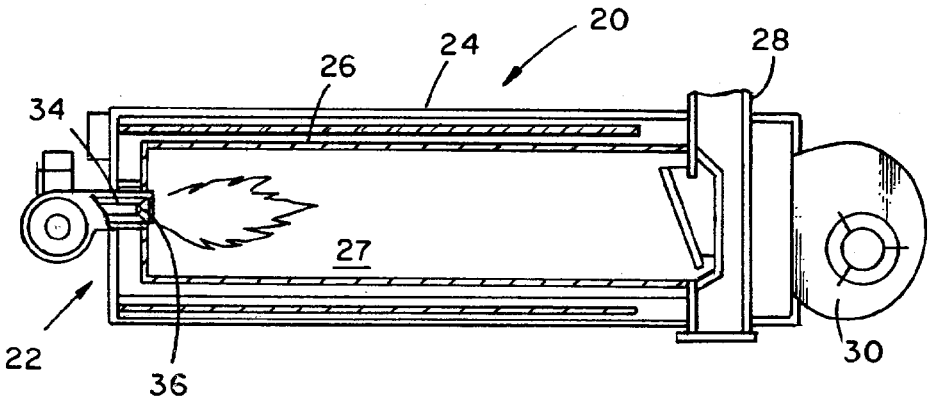
FIG. 2 is a schematic longitudinal cross-sectional view of the furnace of FIG. 1.

Turning now to the drawings in greater detail, there is illustrated in FIGS. 1 and 2 an exemplary system, in the form of a forced air furnace 20, within which an embodiment, generally indicated 22, of a burner assembly is utilized for delivering waste oil and air to a combustion zone of the furnace 20 for burning. Although the waste oil-burning system described herein is a waste oil-burning furnace 20, it will be understood that the principles of the present invention can be incorporated within an alternative waste oil-burning system, such as a boiler system or a refrigeration system, which employs a combustion zone within which waste oil is burned in the presence of air. Accordingly, the principles of the present invention can be variously applied.

The depicted furnace 20 is supported (as from a ceiling or with a free-standing frame structure) in a substantially horizontal orientation of use and, as will be explained herein, draws in room air at one location along the length of the furnace 20 and discharges air at another location along the length of the furnace 20 at a higher temperature.

The depicted furnace 20 includes an elongated outer shell, or housing 24, and a heat exchanger 26 supported within the housing 24 so as to extend along the length of the housing interior. Within the interior of the heat exchanger 26 is defined a combustion zone 27 within which the combustion (i.e. burning) of oil and air takes place, and the burner assembly 22 is supported at one end of the heat exchanger 26 for delivering air and oil into the combustion zone 27 for burning. A flue pipe 28 is joined to the heat exchanger 26 at the end thereof opposite the burner end of the furnace 20 through which the products of combustion are permitted to escape from the heat exchanger 26. In addition, a blower 30 is supported adjacent the end of the housing 26 opposite the burner assembly 28 for forcing room air into the housing 26, along the outer surfaces of the heat exchanger 26 and subsequently out of the housing 26 through a discharge vent 32. It follows that as room air is moved along the outer surfaces of the heat exchanger 26, heat is extracted from the heat exchanger surfaces by the air so that upon the exit of the air from the housing 24, the temperature of the air is appreciably increased. For a more detailed description of the exemplary furnace 20 within which the burner assembly 22 can be utilized, reference can be had to U.S. Pat. No. 4,955,359, the disclosure of which is incorporated herein by reference.

Figure 3:
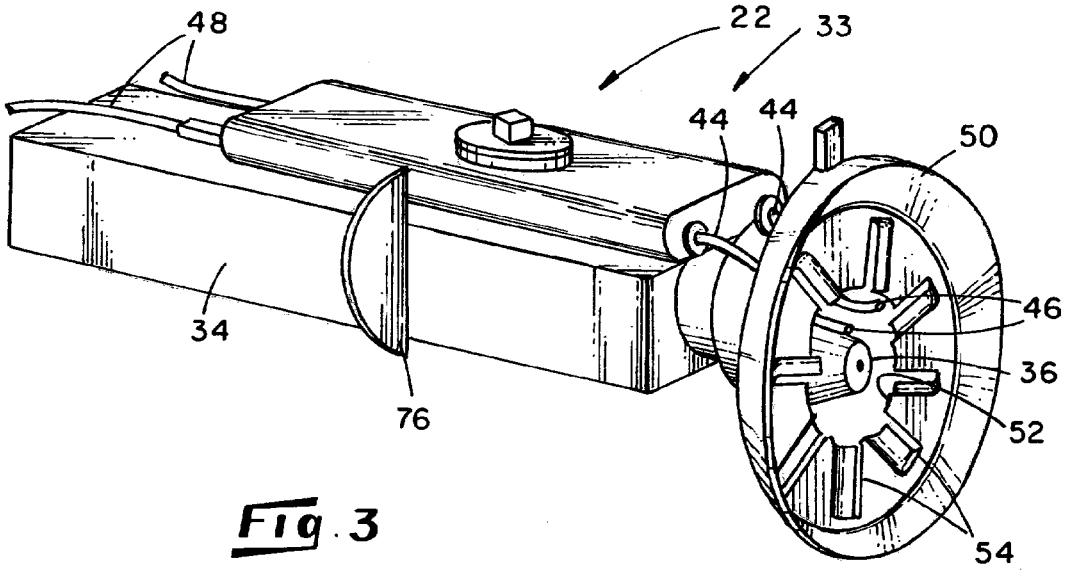
FIG. 3 is a perspective view of a nozzle block assembly utilized in the FIG. 1 furnace.

With reference to FIG. 3, the burner assembly 22 includes a nozzle block assembly 33 comprising the nozzle block 34, introduced above, and an atomizing nozzle 36 joined to one end of the nozzle block 34. The atomizing nozzle 36 (whose construction and operation are well known) includes a central opening through which oil is forced out of the tip end of the nozzle 36 in a manner which atomizes (i.e. breaks up into small droplets) the oil which is pumped out of the nozzle 36 and also includes small air flow channels which surround the central opening of the nozzle through which air, under pressure, is forced out of the tip end of the nozzle 36. The air which is forced out of the nozzle 36 helps to disperse the air through the atomized oil and thereby aids the mixing of the atomized oil with air for subsequent combustion. Moreover, the nozzle block 34 defines internal (air and oil) passageways leading from the rear of the block 34 to the nozzle-end thereof for purposes of delivering the oil and air to the nozzle 36, and the burner assembly 22 includes a compressor 40 (FIG. 1) mounted external to the housing 24 for delivering air, under pressure to the air passageway of the nozzle block 34. Still further, an oil pump (not shown) is utilized for delivering oil to the oil passageway of the nozzle block 34.

For delivering additional air to the combustion zone 27 for burning, the burner assembly 22 includes a blower assembly 42 (FIG. 1) for directing air generally axially along the nozzle block 34 and off of the tip end of the nozzle 36. This blower assembly 42, which includes a centrifugal blower and an associated motor for driving the blower, serves the dual purpose of delivering a significant portion of the air to the combustion zone for burning as well as keeps the flow of combustion products moving through the heat exchanger 26 and toward the flue pipe 28. For channeling this blower-induced air axially along the length of the nozzle block 34, the burner assembly 22 includes an air tube 80 (best shown in FIGS. 4 and 5) along with the nozzle block assembly 33 is supported. In the depicted embodiment, the air tube 80 has an internal diameter of about 3.904 inches and a wall thickness of about 0.048 inches.

For purposes of igniting the oil and air mixture within the combustion zone and with reference again to FIG. 3, the burner assembly 22 includes a pair of electrodes 44 mounted upon the nozzle block 34 and having ends which are disposed adjacent the tip end of the nozzle 36. Leads from a power supply are suitably connected to the ends 48 of the electrodes 44 disposed adjacent the rear end of the block 34 so that actuation of the electrodes 44 (by way of suitable furnace controls) generates sparks between the electrode ends 46 which, in turn, ignite the burn of the oil and air mixture.

The burner assembly 22 also includes an air vane 76 which is secured to one side of the nozzle block 34 so as to extend away from the one side. During operation of the furnace 20, the vane 76 serves as a means for balancing the air flow which flows axially through the air tube 80 and along the opposite sides of the nozzle block 34. In other words, without the air vane 76, the strength of the air flow moving along one side of the nozzle block 34 is not as strong (or equal to) to the strength of the air flow moving along the opposite side of the nozzle block 34. However, by attaching the air vane 76 on the side of the nozzle block 34 along which the air flow would otherwise be the greatest, the strength of the air flow moving along the opposite sides of the nozzle block 34 is substantially balanced. This balanced air flow is advantageous in that it helps to center the flame within the heat exchanger 26, contributes to the efficiency of the furnace 20 and the reliability of flame ignition at furnace start-up, and also aids in the burning of hydrocarbons in the waste oil being burned.

With reference to FIGS. 3–6, the burner assembly 22 further includes a platen-like flame retention head 50 supported by the nozzle block 34 so as to surround the nozzle 36. Flame retention heads which are positioned adjacent the atomizing nozzle are known to be capable of maintaining the flame (of the burn) closer to the atomizing nozzle than would be the case without the flame retention head and are responsible for lowering the amount of air which is required for combustion to accommodate relatively small rates of air flow along the nozzle block assembly. As will be apparent herein, the flame retention head 50 described herein provides the additional benefit of promoting complete combustion of the atomized oil and air so that no appreciable amount of hydrocarbons are unburned within the heat exchanger 26 that could subsequently escape the furnace 20 through the flue pipe 28.

Figure 4:
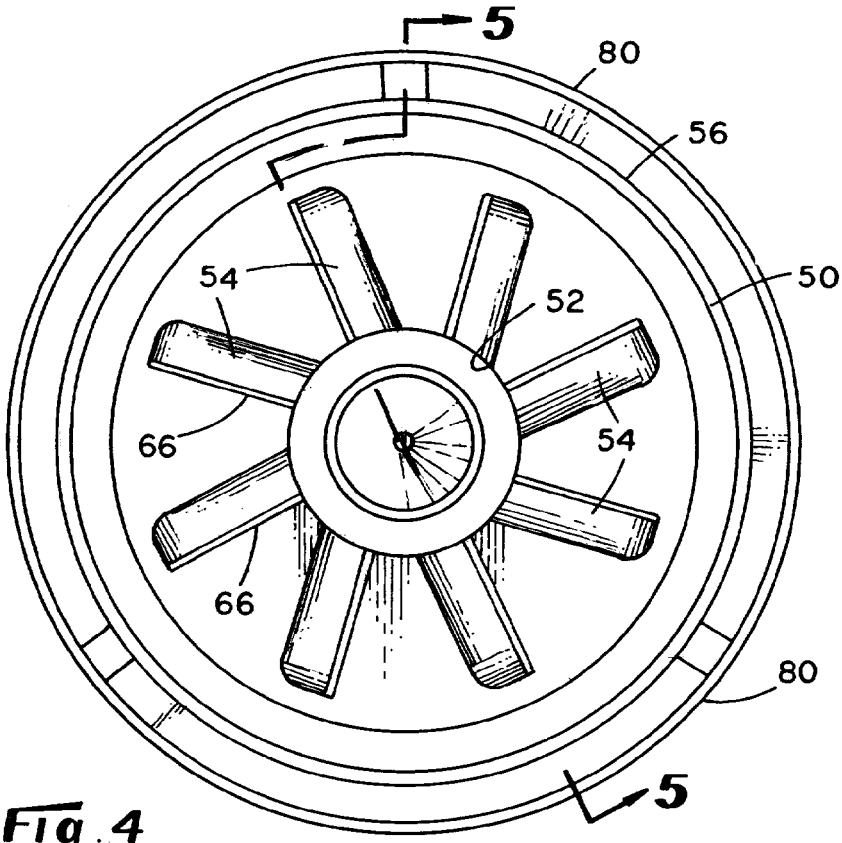
FIG. 4 is a front elevational view of the assembly of FIG. 3 as seen generally from the right in FIG. 3.
Figure 5:
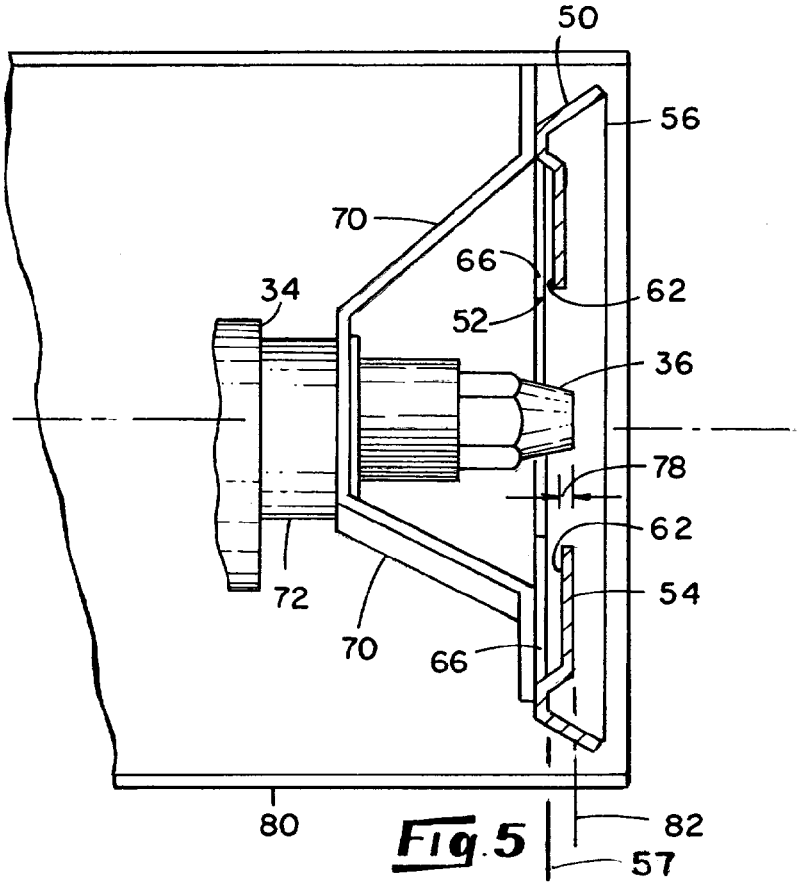
FIG. 5 is a cross-sectional view taken about along line 5—5 of FIG.

As best shown in FIGS. 4 and 5, the flame retention head 50 is formed from a single, circular plate of steel comprised, for example, of 18 gauge cold-rolled steel which has been suitably stamped to form a central through-opening 52, a plurality of vanes 54 (e.g. a total of eight) which extend radially of the through-opening 52, and an arcuate lip 56 which is formed along the periphery of the head 50. The body of the head 50 from which the lip 56 and the vanes 54 project lies in the plane indicated 57 in FIG. 5. The through-opening 52 has a diameter in the range of between about 1.30 and 1.35 inches (preferably about 1.312 inches), while each vane 54 has a length of about 0.687 inches and preferably about 0.750 inches as measured along the vane 54 from the through-opening 52.

Figure 6:
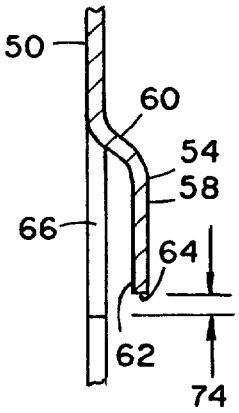
FIG. 6 is a view of a fragment of the flame retention head illustrated in FIG. 5 but drawn to a slightly larger scale.

Moreover, the vanes 54 are formed so that each vane 54 is provided with somewhat of an L-shaped cross section (as best shown in FIGS. 5 and 6) having a long and short leg 58 and 60, respectively. Furthermore, each vane 54 is joined to the remainder of the head 50 by way of the short leg 58 but its long leg 60 is separated from the remainder of the head 50 along the length of the leg 60 so as to provide a gap 62 between the vane edge, indicated 64, and the adjacent edge, indicated 66, formed in the head 50. In other words, the formation of the vanes 54 separate the vanes 54 and the remainder of the head 50 along a path which is bordered by the edges 64 and 66, as well as provides the vanes 54 with the aforedescribed L-shape. This gap 62 extends about along the entire length of each vane 54 and has a width (as measured normal to the plane of the head 50) which is no less than about 0.07 inches (preferably about 0.072 inches, i.e. between about 0.07 and 0.075 inches). In addition and as viewed from the front of the head 50, the edges 64 and 66 are spaced apart by gap 74 having a width of about 0.036 inches. During use of the flame retention head 50, air flows through the gaps 62 from the rear of the head 50 (i.e. from the left as viewed in FIG. 6) while the vanes 54 direct the flow of air through the gaps 62 along a swirling, or cyclone, motion toward the flame in the combustion zone 27.

As best shown in FIG. 5, the lip 56 is disposed outboard of so as to encircle the vanes 54 and provides the perimetal edge of the head 50. This lip 56 helps to prevent movement of atomized oil beyond the radial boundary of the head 50 so that the flame of the burn is substantially confined inboard of the lip. In other words, if the head 50 did not possess the lip 56, the flame of the burn would not be necessarily confined inboard of the periphery of the head 50. The diameter of the head 50, as measured through the center of the head 50 and across the outer edges of the lip 56, is about 3.45 inches (and preferably about 3.446 inches).

The flame retention head 50 is secured to the nozzle block 34 by means of a plurality of (i.e. three) support struts 70 which are joined at one end to the rear surface of the head 50, as with spot welds, and is joined at the other end to a collar 72 which encircles the body of the nozzle block 34 in a close-fitting relationship. In the depicted embodiment, the struts 70 are formed as a one-piece unit out of steel (e.g. 18 gauge cold-rolled steel), and each strut 70 is suitably bent at one end thereof to accommodate the spot-welding of the bent end of the strut 70 to the rear surface of the head 50. Furthermore, the struts 70 support the retainer head 50 about the nozzle 36 so that the vanes 54 (whose forward surfaces define a plane indicated 82 in FIG. 5) project forwardly relative to the remainder of the head 50 and so that the tip, or forward, end of the nozzle 36 projects forwardly of the plane 82 defined by the vanes 54 by a spacing, indicated 78 in FIG. 5, having a width which is at least about 0.06 inches, but no greater than about 0.11 inches, and preferably about 0.062 inches.

During assembly of the burner assembly 22, the collar 72 is secured in an abutting relationship with the forward end of the nozzle block 34 so that the struts 70 support the retainer head 50 so that the plane 82 is spaced from the tip end of the nozzle 36 by the desired spacing of between about 0.06 and 0.11 inches. Therefore, if for some reason, the burner assembly 22 must be disassembled and subsequently re-assembled in the field, the retainer head-to-collar relationship ensures that upon re-assembly of the burner assembly components, the retainer head 50 is in a desired positional relationship relative to the tip of the nozzle 36 for furnace operation.

Several of the aforementioned dimensions relating to the retention head 50 and the relationship between the head 50 and the nozzle block 34 have been selected to enhance the burn of the atomized oil directed out of the nozzle 36. In this connection and for purposes of discussion herein, primary air (i.e. the flame retention air) is considered as the air which is directed around, or past, the nozzle 36 through the central opening 52 (and amounts to about 30% of the total air directed into the heat exchanger 26, excluding the amount of air which is directed out of the tip of the nozzle 36), while secondary air is the air which is directed through the gaps 62 associated with the vanes 54 (and amounts to about 10% of the flame retention air). Tertiary air (which amounts to about 60% of the total flame retention air) is the flame-containing air flowing through the air tube 80 which, along with the primary and secondary air, completes the burn. Accordingly and as used herein, the term flame retention air does not include the air (i.e. combustion air) which is delivered to the burn through the tip of the nozzle 36.

With the foregoing in mind, the size of the central opening 52 (with its 1.312 inch diameter) permits a large flow of primary air flow around the nozzle 36 and toward the burn. Moreover, a portion of the secondary air which travels along the nozzle block 34 flows through the gaps 62 provided along the vanes 54 so that this air moves in a swirling path which retains the flame in close proximity to the forward face of the flame retention head 50. The size of each gap 62 (i.e. 0.072 inches) is controlled to permit an optimum volumetric flow rate of the secondary air through the vanes 54. Still further, the spacing 78 (e.g. 0.062 inches) between the tip end of the nozzle 36 and the plane 82 defined by the vanes 54 and the overall diameter (3.446 inches) have been selected to take better advantage of the tertiary air (amounting to about 60% of the flame retention air) surrounding the burn.

Flame retention heads for fuel oil furnaces of the prior art possess central (i.e. primary air) through-openings which measure about 0.875 inches in diameter, and the gaps alongside the vanes 54 measure about 0.060 inches. By increasing the diameter of the through-opening 52 to the selected 1.312 inches, the flow of primary and secondary air flow to the burn is increased. Similarly, by increasing the size of the gaps 62 at the vanes 54 from 0.060 inches to 0.072 inches permits a greater volume of secondary air flow through the gaps 62 to the burn. Furthermore, by altering the relationship of the tip end of the nozzle 36 so that it projects forwardly of the plane 82 of the vanes 54 by the exemplary distance of about 0.062 inches and by decreasing the outer dimension of the head 50 to a fixed dimension of 3.446 inches (from a prior art dimension of 3.565 inches) advantageously increases the flow and effect of tertiary air which contains the flame. The pattern of tertiary air is a cylindrical contained pattern which, with the aid of the arcuate lip 56, confines the burning into a compact form to ensure complete burning of all of the atomized droplets.

Before the design of the aforedescribed flame retention head 50 was finalized, several designs were tested. The final version of the head 50 (and whose dimensions are set forth above) provided the best (and less-deleterious) test results relating to the completeness of the burn within the combustion zone 27. In this connection, samples taken within the flue pipe 28 the furnace 20, when compared against samples taken within the flue pipe of an alternative furnace utilizing a flame retention head of the prior art, revealed an appreciable reduction in the amount of unburned hydrocarbons.

It follows that a burner assembly which utilizes the aforedescribed improved flame retention head 50 and burner assembly 22 reduces the emission of unburned hydrocarbons and carbon monoxide into the atmosphere. Moreover, the head 50 contributes to better ignition reliability and results in improved combustion performance over a wider range of flow rates and altitudes. In this connection, the burning is improved by controlling the aforedescribed dimensions of the flame retention head and the positional relationship between the nozzle 34 and the head 50.

The fixed relationship of the nozzle 36 to the head 50 is also advantageous from an installation standpoint. In this connection, oil flame retention devices have traditionally been adjusted by an installer who adjusts the nozzle-to-device spacing for the most favorable burn. Except at appreciably high altitudes (e.g. in excess of about 5,000 feet), no adjustments need to be made by an installer of the nozzle-to-device spacing when a furnace employs the burner assembly design described herein and a metering pump, such as is described in U.S. Pat. No. 5,372,484 referenced herein, and a draft is set at a specific setting. At the appreciably high altitudes, the only adjustment which may be required by the installer to such a furnace is the combustion air shutter.

It will be understood that numerous modifications and substitutions can be had to the aforedescribed embodiment without departing from the spirit of the invention. Accordingly, the aforedescribed embodiment is intended for the purpose of illustration and not as limitation.

What is claimed is:

1. A flame retention head for a nozzle block assembly of a waste oil-burning system having a combustion zone within which waste oil is burned in the presence of air and wherein the nozzle block assembly includes an atomizing nozzle through which oil and air are delivered to the combustion zone of the system for burning, the flame retention head comprising:

a platen-like body of substantially circular form having a central opening through which the atomizing nozzle is positioned for directing air and oil into the combustion zone for burning, and wherein the central opening has a diameter of no less than about 1.3 inches;

the platen-like body including a plurality of radially-extending vanes formed therein wherein each vane forms with the remainder of the platen-like body a gap which is joined to and extends radially-outwardly of the central opening and wherein each gap has a width which is no less than about 0.07 inches.

2. The flame retention head as defined in claim 1 wherein the diameter of the central opening of the platen-like body is within the range of between about 1.3 and 1.35 inches.

3. The flame retention head as defined in claim 1 wherein each gap formed in the platen-like body has a width which is in the range of between about 0.07 and 0.075 inches.

4. The flame retention head as defined in claim 1 wherein the radially-extending vanes have forward surfaces disposed on the side of the platen-like body corresponding with the combustion zone and wherein the forward surfaces define a plane, the nozzle has a forward tip through which oil and air exit the nozzle, and the forward tip of the nozzle extends through the central opening of the platen-like body and is spaced forwardly of the plane defined by the forward surfaces by a distance of at least about 0.06 inches.

5. The flame retention head as defined in claim 4 wherein the forward tip of the nozzle is spaced forwardly of the plane defined by the forward surfaces by a distance within the range of about 0.06 and 0.11 inches.

6. The flame retention head as defined in claim 1 wherein the platen-like body has an outer diameter of about 3.446 inches.

7. The flame retention head as defined in claim 1 wherein each vane is L-shaped in cross section having a short leg which extends normal to the plane of the platen-like body and a long leg which is disposed parallel to the plane of the platen-like body, the long leg having a free edge which borders one side of a corresponding gap in the vane.

8. The flame retention head as defined in claim 1 wherein the length of each gap as measured therealong from the central opening is about 0.75 inches.

9. A burner assembly for a waste oil-burning system having a combustion zone within which waste oil is burned in the presence of air; the burner assembly comprising:

a nozzle block assembly including an atomizing nozzle through which oil and air are delivered to the combustion zone of the system for burning;

a flame retention head attached to the nozzle block assembly and having a platen-like body of substantially circular form and having a central opening through which the atomizing nozzle is positioned for directing air and oil into the combustion zone for burning, and wherein the central opening of the platen-like body has a diameter of no less than about 1.3 inches, and wherein the platen-like body includes a plurality of radially-extending vanes formed therein wherein each vane forms with the remainder of the platen-like body a gap which is joined to and extends radially-outwardly of the central opening and wherein each gap has a width which is no less than about 0.07 inches.

10. The burner assembly as defined in claim 9 wherein the diameter of the central opening of the platen-like body of the flame retention head is within the range of between about 1.3 and 1.35 inches.

11. The burner assembly as defined in claim 9 wherein each gap formed in the platen-like body of the flame retention head has a width which is in the range of between about 0.07 and 0.075 inches.

12. The burner assembly as defined in claim 9 wherein the radially-extending vanes have forward surfaces disposed on the side of the platen-like body corresponding with the combustion zone and wherein the forward surfaces define a plane, the nozzle has a forward tip through which oil and air exit the nozzle, and the forward tip of the nozzle extends through the central opening of the platen-like body and is spaced forwardly of the plane defined by the forward surfaces by a distance of at least about 0.06 inches.

13. The burner assembly as defined in claim 12 wherein the forward tip of the nozzle is spaced forwardly of the plane defined by the forward surfaces by a distance within the range of about 0.06 and 0.11 inches.

14. The burner assembly as defined in claim 13 wherein the forward tip of the nozzle is spaced forwardly of the plane defined by the forward surfaces by a distance of about 0.062 inches.

15. The burner assembly as defined in claim 9 wherein the platen-like body of the flame retention head has an outer diameter of about 3.446 inches.

16. The burner assembly as defined in claim 9 wherein each vane is L-shaped in cross section having a short leg which extends normal to the plane of the platen-like body and a long leg which is disposed parallel to the plane of the platen-like body, and the long leg has a free edge which borders one side of a corresponding gap in the vane.

17. The burner assembly as defined in claim 9 wherein the length of each gap as measured therealong from the central opening is about 0.75 inches.

18. The burner assembly as defined in claim 9 wherein the waste oil burning system with which the burner assembly is used includes an elongate air tube through which flame retention air is forced toward the combustion zone and within which the nozzle block assembly of the burner assembly is supported, and wherein about 30% of the total amount of flame retention air directed toward the combustion zone through the air tube is moved toward the combustion zone through the central opening of the platen-like body.

19. A burner assembly for a waste oil-burning system having a combustion zone within which waste oil is burned in the presence of air; the burner assembly comprising:

a nozzle block assembly including an atomizing nozzle through which oil and air are delivered to the combustion zone of the system for burning and a nozzle block body having opposite sides along which air is moved as the air flows toward the combustion zone;

means attached to the nozzle block body for balancing the strength of the air flow moving along the opposite sides of the nozzle block body;

a flame retention head attached to the nozzle block assembly and having a platen-like body of substantially circular form and having a central opening through which the atomizing nozzle is positioned for directing air and oil into the combustion zone for burning, and wherein the platen-like body includes a plurality of radially-extending vanes formed therein wherein each vane forms with the remainder of the platen-like body a gap which is joined to and extends radially-outwardly of the central opening.

20. The burner assembly as defined in claim 19 wherein the means for balancing includes at least one air vane attached to so as to extend away from one side of the nozzle block body.

21. The burner assembly as defined in claim 19 wherein the waste oil-burning system with which the burner assembly is used includes an elongate air tube through which flame retention air is forced toward the combustion zone and within which the nozzle block assembly of the burner assembly is supported, and wherein about 30% of the total amount of flame retention air directed toward the combustion zone through the air tube is moved toward the combustion zone through the central opening of the platen-like body.

* * * * *